United States Patent [19]

Taylor

[11] 4,443,050

[45] Apr. 17, 1984

[54] ELECTRICAL INTERCONNECTORS

[75] Inventor: John C. Taylor, Ballasalla, Isle of Man

[73] Assignee: Strix Limited, Port Erin, Isle of Man

[21] Appl. No.: 484,917

[22] Filed: Apr. 8, 1982

Related U.S. Application Data

[63] Continuation of Ser. No. 237,137, filed as PCT GB80/00103, Jun. 13, 1980, published as WO80/02892, Dec. 24, 1980, § 102(e) date Feb. 10, 1981, abandoned.

[30] Foreign Application Priority Data

Jun. 13, 1979 [GB] United Kingdom ..... 7920525
Aug. 21, 1979 [GB] United Kingdom ..... 7929125

[51] Int. Cl.[3] ..... H01R 13/39
[52] U.S. Cl. ..... 339/99 R; 339/147 P
[58] Field of Search ..... 339/97 R, 97 L, 97 P, 339/97 S, 97 T, 98, 99, 147 P

[56] References Cited

U.S. PATENT DOCUMENTS

| | | | |
|---|---|---|---|
| 2,265,360 | 12/1941 | Dessart | 339/99 L |
| 2,518,489 | 8/1950 | Orlando | 339/97 R |
| 3,274,531 | 9/1966 | Bourhenne | 339/99 R |
| 3,457,359 | 7/1969 | Loucy | 339/97 R |
| 3,710,305 | 1/1973 | Clark | 339/97 R |
| 3,816,819 | 6/1974 | Judd | 339/99 R |
| 3,860,316 | 1/1975 | Hardesty | 339/99 R |
| 3,976,967 | 8/1976 | Magherini | 339/147 P |
| 4,062,615 | 12/1977 | Navarro | 339/98 |
| 4,148,540 | 4/1979 | Hayes | 339/99 R |

FOREIGN PATENT DOCUMENTS

| | | | |
|---|---|---|---|
| 545734 | 3/1956 | Belgium | 339/99 R |

*Primary Examiner*—Joseph H. McGlynn

[57] ABSTRACT

An electrical interconnector, e.g. a male pin plug, comprises electrical connector members and associated terminals which are formed from sheet metal. The terminals include at least one (1) tooth adapted to pierce the insulation to make contact with the conductors of a multi-strand cable when the cable is forced into a groove which is sized and shaped to function as a trap which captures and guides the cable.

16 Claims, 31 Drawing Figures

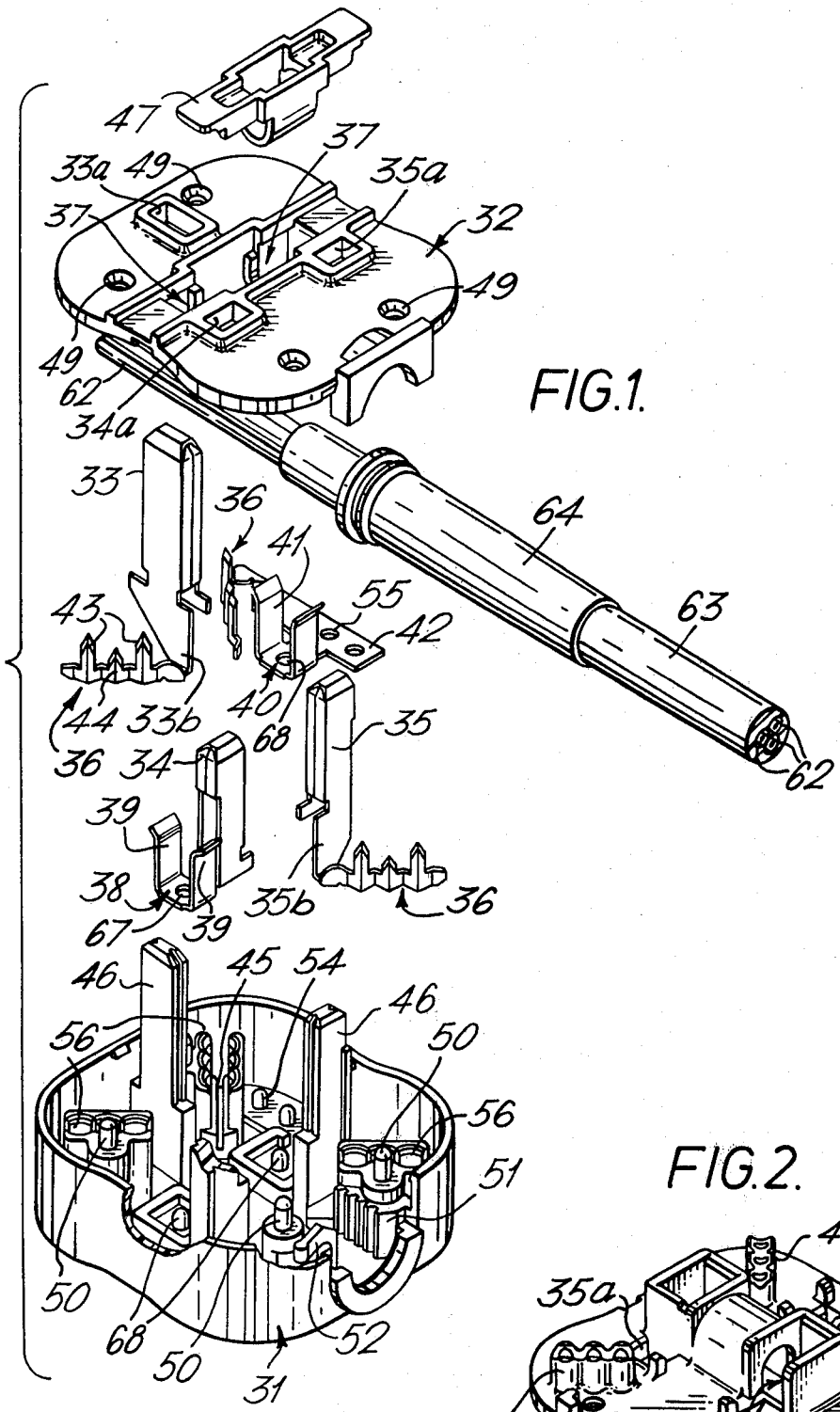
FIG.1.
FIG.2.
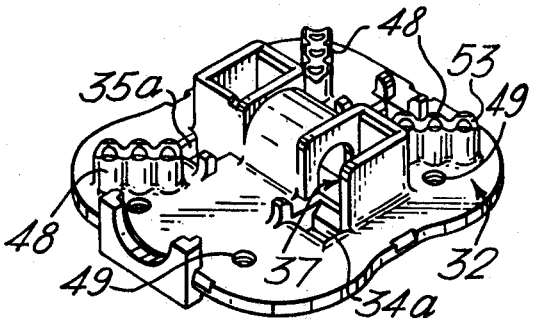

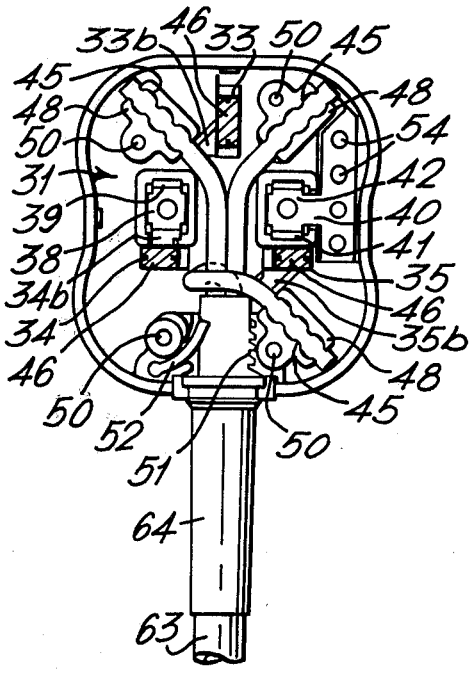
FIG.3.
FIG.4.
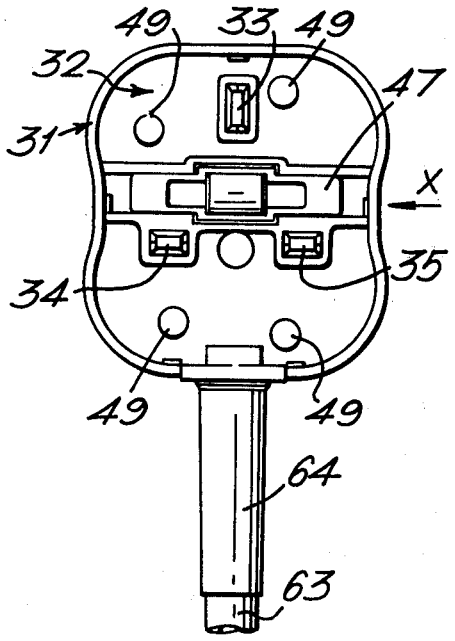
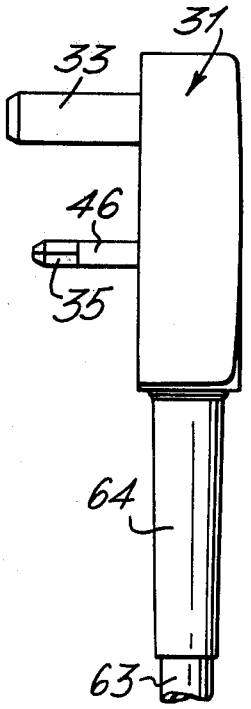
FIG.5.

FIG.17.
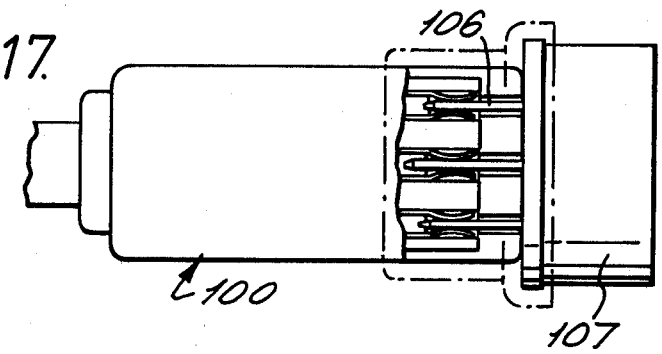
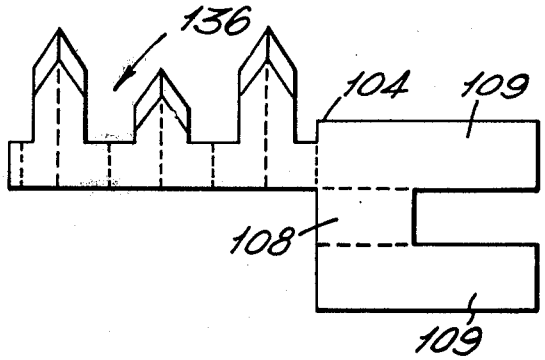
FIG.18.
FIG.20.
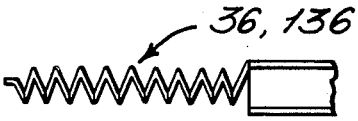
FIG.19.
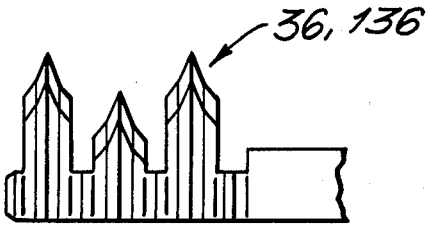

ELECTRICAL INTERCONNECTORS

This is a continuation, of application Ser. No. 237,137, as PCT GB 80/00/03, Jun. 13, 1980, published as WO 80/02892, Dec. 24, 1980, § 102(e) date filed Feb. 10, 1981 now abandoned.

This invention relates to electrical interconnector such as male pin plugs, female sockets, bayonet and Edison screw light fittings, bulb holders, etc wherein each such interconnector includes one or more electrical connector members such as pins, sockets, sprung contacts or fuse holders for mechanical engagement with and disengagement from cooperating electrical connector members to make electrical connection therewith, a terminal being associated with each said one or more electrical connector members of the interconnector whereby the connector member may be electrically connected to an insulated multi-strand conductor i.e. a conductor having a conducting strand bundle encased in an insulating sheath. An electrical interconnector as above described will hereinafter be termed an electrical interconnector of the kind referred to.

The form taken by such terminals and electrical connector members in electrical interconnectors of the kind referred to in common use, e.g. in connection with domestic electrical appliances is surprisingly varied and complicated as is evidenced, for example, by the many forms of the pins and associated terminals of the 13 amp mains plug. The making of the electrical connections with said terminals is also generally tedious and time consuming involving removing the insulating sheath from the end of the conductor.

In addition, the removal of the insulating sheath allows the individual strands of the conductor to become separated, thus presenting an electrical hazard unless great care is taken.

It is an object of the present invention to simplify and hence reduce the cost of the construction of the electrical connector members and their associated terminals of electrical interconnectors of the kind referred to as well as to facilitate and quicken the making of electrical connections to said terminals and to avoid the dangers inherent in baring the strands of the conductor.

Thus, according to the present invention, there is provided an electrical interconnector of the kind referred to wherein a or each electrical connector member and its associated terminal is constituted by a connector element formed from sheet metal, the terminal being constituted by at least one piercing means adapted to pierce the insulation of an insulated multi-strand conductor and the strand bundle thereof to make electrical connection therewith.

Sheet metal e.g. brass, can readily be stamped into blanks and formed up to provide hollow pins (see British Patent Specification No. 1370613), sockets or other forms of electrical connector members connected as required to the aforesaid piercing means to provide an extremely inexpensive and simple single connector element of readily variable configuration to replace the variety of parts customarily provided at present in many interconnectors of the kind referred to. The piercing means avoids the need to bare the multi-strand electrical conductor as is presently usual thus greatly speeding the making of an electrical connection. For this purpose the interconnector can readily be constructed to facilitate correct presentation of the electrical conductors to the piercing means, e.g. as by locating the piercing means in a groove shaped to receive an electrical conductor, and furthermore the interconnection of parts of the interconnector can serve to bring about a controlled and predetermined piercing action thus ensuring that correct electrical connections are made reliable and without difficulty.

The piercing means may comprise one or more teeth, each tooth preferably being pointed and bevelled to provide a sharp leading end. If one or two teeth are used, it is preferred that the teeth enter the insulation from one side, pass through the strand bundle of the electrical conductor and then pass through the insulation at the opposite side to that at which the teeth entered the insulation.

If three teeth are used, the centre tooth is preferably shorter than the two outer teeth. In this way, the two outer teeth first pass through the conducting strand bundle, tightening the strand bundle between them due to the spreading action of the teeth, and then the centre tooth enters the bundle, further tightening the already tightened strand bundle which is anchored by the two outer teeth.

As previously stated the piercing means is preferably located in a groove shaped to receive an electrical conductor. Such groove can advantageously be formed as a trap to receive as a press fit the electrical conductor, desirably so that the piercing means just engages the insulating sheath to locate the conductor against axial displacement. Where the piercing means comprises three teeth, the centre one of which is shorter than the two outer teeth, then the arrangement is preferably such that only the outer teeth engage the insulation when the conductor is first pressed into said groove. A part of said interconnector for engagement with the part provided with said trapping groove, may be provided with a knuckle adapted to enter each said trap to engage said conductor and force it further into said groove, said complete piercing of the conductor then being achieved as the traps and knuckles are brought together. Holes or recesses may be provided in the knuckles to receive the piercing means, e.g. the teeth of a toothed piercing means, extending through the conductor, which interengagement of holes or recesses and piercing means serves to locate and guide the piercing means relative to the knuckles as the knuckles complete their entry into said traps.

It is preferred for the piercing means to be folded along one or more lines extending in the direction in which the piercing means enters the electrical conductor. This gives the piercing means additional rigidity which is important when the connector element is formed from relatively thin sheet material. In addition, the folding enables the piercing means to be supported as an interference fit in a comparatively broad slot in an insulating member, such a broad slot being more easily moulded in a moulded part of the interconnectors than a narrow slot of width equal to the thickness of the sheet metal from which the connector element is made. Where the piercing means comprises one or more teeth, it is preferred to provide at least one fold along the axis of the or each tooth and at each side of the or each tooth.

In a further preferred arrangement, the or each tooth is formed into a W-shape in cross-section, having a first fold along the axis thereof, and two further folds in the opposite direction, one each side of and parallel to the first fold. In this way extremely rigid teeth can be formed from thin sheet material. Each fold preferably includes an angle of approximately 60°.

Alternatively, the piercing means may be formed of sheet metal having a sufficient thickness for the teeth to remain rigid during entry into the conductor without folding and to enable a mounting slot of width equal to the thickness of the sheet readily to be formed in an insulating member.

In the accompanying drawings;

FIG. 1 is a perspective exploded view of a male plug including connector elements according to the invention;

FIG. 2 is a perspective view of the underside of a base part of the plug of FIG. 1;

FIG. 3 is an underneath plan view of the plug of FIG. 1 with the base part removed;

FIG. 4 is an underneath plan view of the assembled plug; of FIG. 1

FIG. 5 is a side elevation of the plug of FIG. 1 viewed in the direction X of FIG. 4;

Figure 6A:
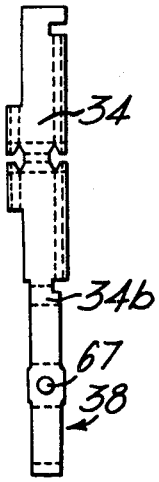
Figure 6B:
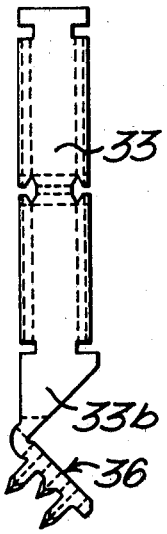
Figure 6C:
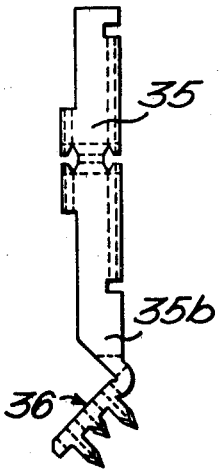
Figure 6D:
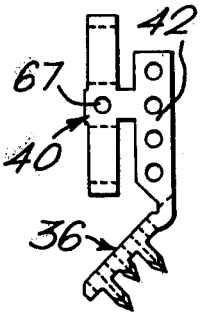
Figure 7:
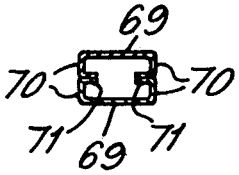
Figure 8:
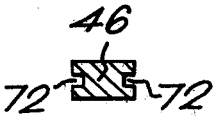
Figure 9:
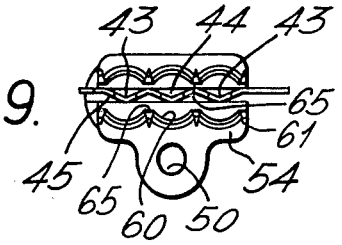
Figure 10A:
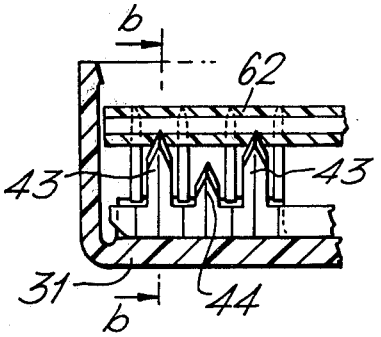
Figure 10B:
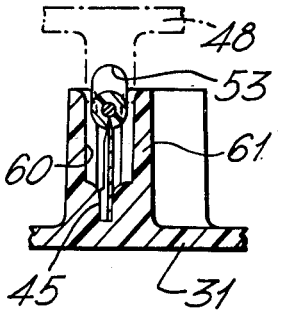
Figure 11A:
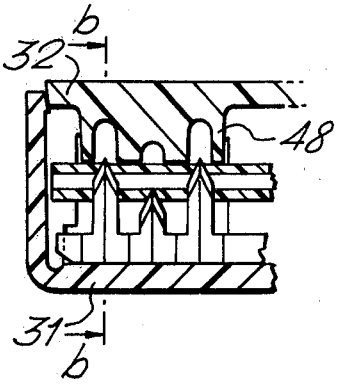
Figure 11B:
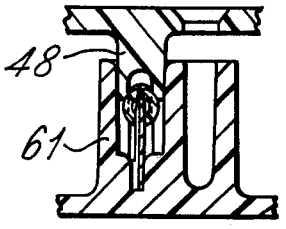
Figure 12A:
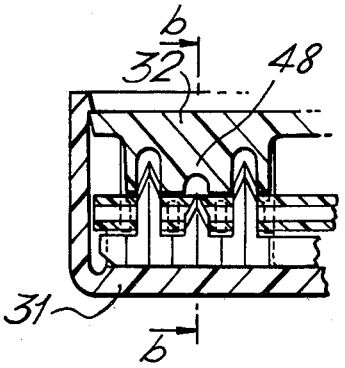
Figure 12B:
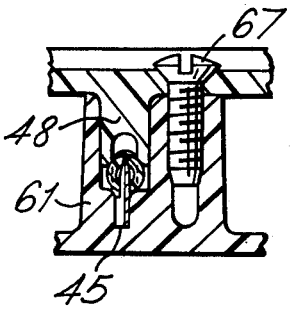
Figure 13:
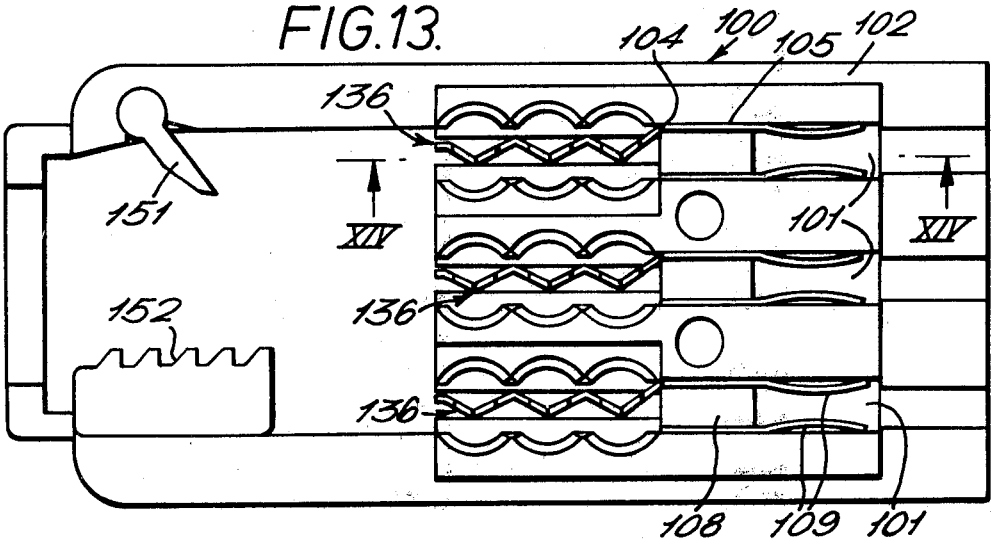
Figure 14:
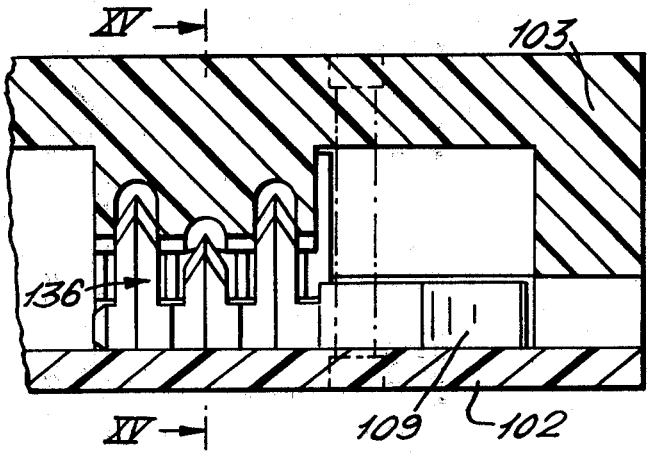
Figure 15:
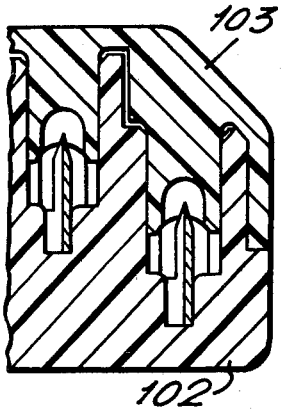
Figure 16:
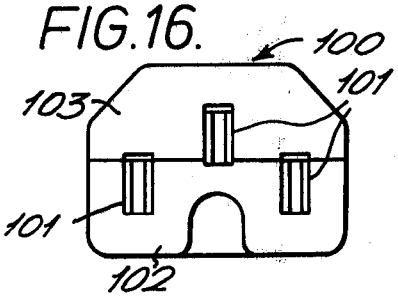
Figure 21:
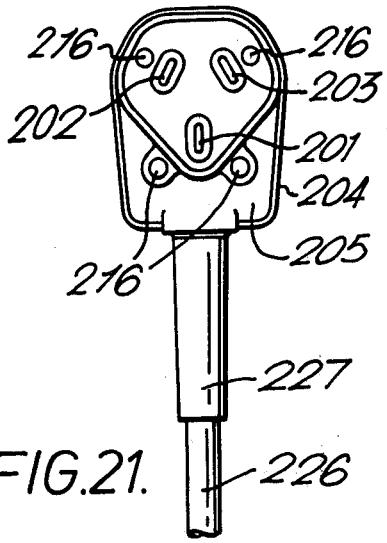
Figure 22:
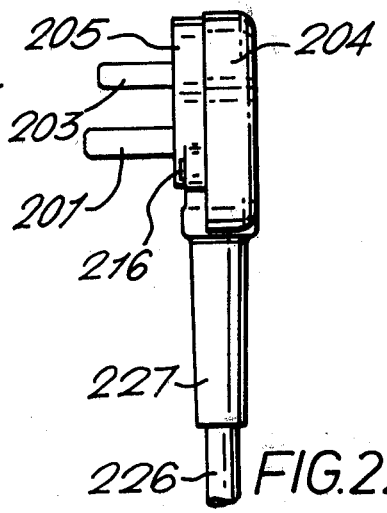
Figure 23:
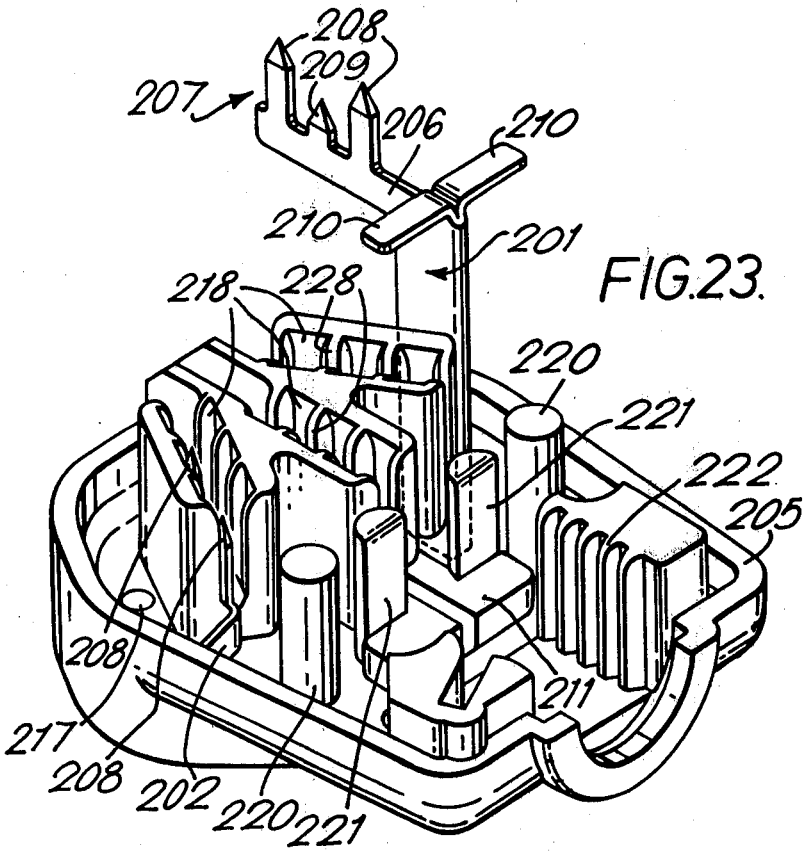
Figure 24:
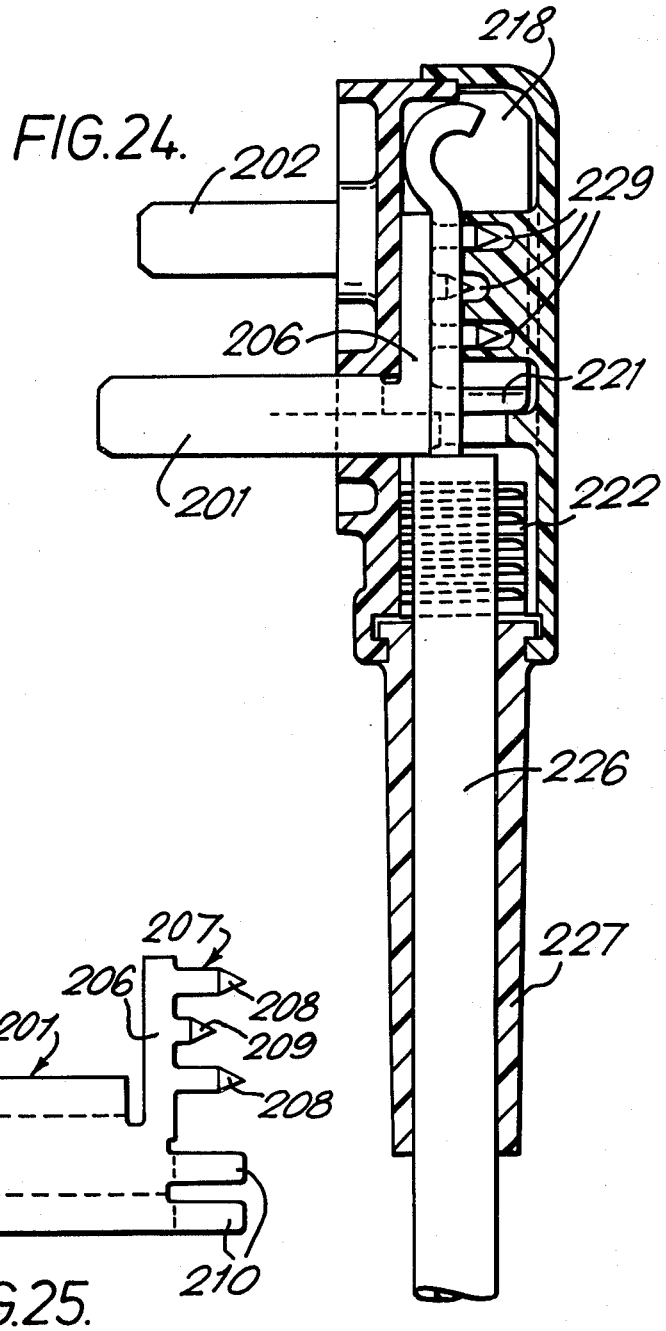
Figure 25:
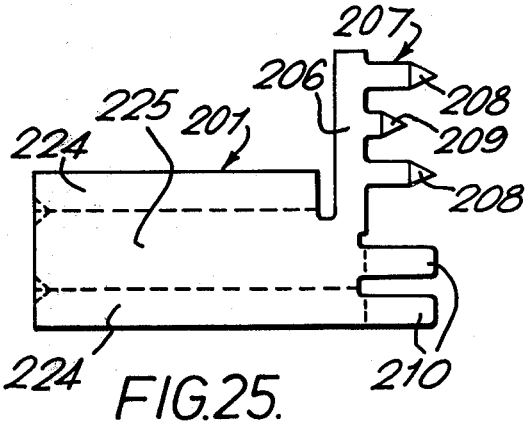
Figure 27:
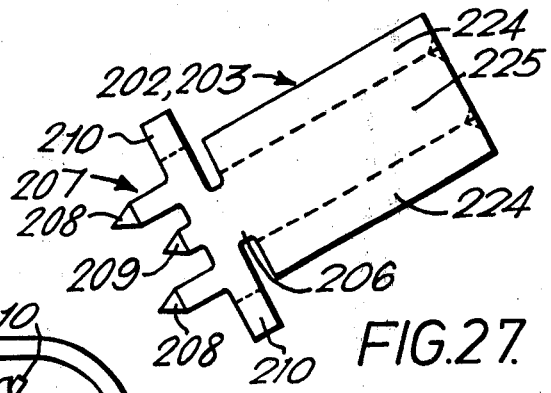
Figure 26:
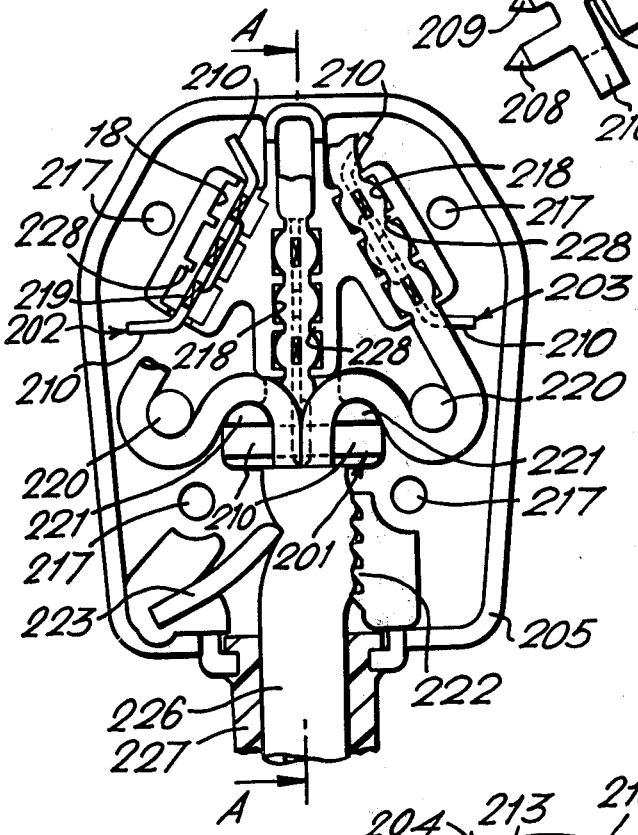
Figure 28:
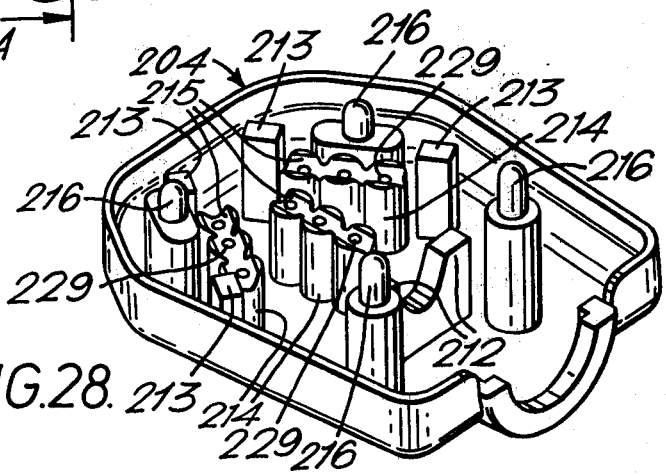

FIGS. 6, *a, b, c* and *d* are plan views of the sheet metal blanks from which are formed respectively the line pin and fuse holder, the earth pin and terminal, the neutral pin and terminal, and the line terminal and fuse holder;

FIGS. 7 and 8 are detail views to an enlarged scale showing the cross-sectional shape of formed-up pins and associated plastics reinforcing pins;

FIG. 9 is a plan view of a detail of part of the plug unit of FIGS. 1 to 5;

FIGS. 10*a*, 11*a* and 12*a* are part sectional views to an enlarged scale showing the progressive engagement of terminal piercing means with an insulated conductor to make electrical connection therewith;

FIGS. 10*b*, 11*b* and 12*b* are sectional views on the lines b—b of FIGS. 10*a*, 11*a* and 12*a* respectively;

FIG. 13 is a plan view of a female socket including connector elements according to the invention with a cover part removed;

FIG. 14 is a part sectional view on line XIV—XIV of FIG. 13;

FIG. 15 is a part sectional view on line XV—XV of FIG. 14;

FIG. 16 is an end elevation to a reduced scale of the socket of FIGS. 13–15;

FIG. 17 is a plan view to the same scale as FIG. 16 of the socket illustrating its engagement with a male plug unit;

FIG. 18 is a plan view of a sheet metal blank from which the connector elements of the socket of FIGS. 13–17 are formed;

FIGS. 19 and 20 are side and plan views to an enlarged scale of a modified form of piercing means;

FIG. 21 is an underneath plan view of a three pin mains plug including connector elements according to the invention;

FIG. 22 is a side elevation of the plug of FIG. 21; of the remaining views which are to an enlarged scale;

FIG. 23 is a perspective view of the base of the plug of FIG. 21 with the cover removed showing the earth pin before insertion;

FIG. 24 is a side elevation corresponding to FIG. 22 in section on the line A—A of FIG. 26;

FIG. 25 shows a sheet metal blank for the earth pin of the plug of FIG. 21;

FIG. 26 is a plan view of the base of the plug of FIG. 21, the cover having been removed;

FIG. 27 shows a sheet metal blank for the line or neutral pins of the plug of FIG. 21, and FIG. 28 is a perspective view of the cover of the plug of FIG. 21.

FIGS. 1 to 12 of the drawings show an electrical interconnector in the form of a non-rewireable male pin plug comprising three electrical connectors in the form of hollow male pins 33, 34 and 35. As shown in FIG. 1, the plug comprises a moulded plastics cover part 31 and a moulded plastics base part 32.

The pins 33, 34, 35 constitute an earth pin 33, a line pin 34 and a neutral pin 35, each pin being part of a connector element formed from a sheet metal blank as shown in FIGS. 6 *a,b,c*, the fold lines being shown dotted. The pins 33, 34, 35 are held in position between the cover part 31 and the base part 32 and extend through holes 33*a*, 34*a*, 35*a* respectively in the base part 32. The pins 33, 34 and 35 being of hollow construction and being formed from a sheet metal blank, enables them to be formed integrally with respective conductive strips 33*b*, 34*b*, 35*b*. The line pin 34 is formed integrally with a fuse holder 38 at an extension of conductive strip 34*b*, the holder 38 comprising a pair of spring members 39 which may be forced apart to receive one end of a fuse therein. A further electrical connector in the form of a second fuse holder 40 is provided as part of a connector element formed from a sheet metal blank as shown in FIG. 6*d*. This fuse holder 40 also comprises a pair of spring members 41 formed integrally with a conductive strip 42.

Each of the conductive strips 33*b*, 35*b* and 42 has formed integrally therewith as part of the same blank a terminal in the form of means 36 for piercing the insulation of a multi-strand conductor so as to be in electrical contact therewith. Each piercing means 36 comprises three teeth, two outer teeth 43 and a centre tooth 44 shorter than the outer teeth. In addition, each tooth has a fold extending along the length thereof, and a fold is also arranged between the teeth and each side of the two outer teeth 43. It has been found that a fold through an angle of approximately 60° produces a strong piercing means. Adjacent folds face opposite sides of the strip, so that the strip forms a zig-zag in plan, as shown in FIG. 9. By virtue of this arrangement, the piercing means is strengthened and the piercing means can be an interference fit in a slot 45 in the cover part 31. Each tooth 43, 44 is bevelled to a sharp point on one side only on the obtuse side of the fold extending along the tooth. In this manner, the point of each tooth enters the insulation of the electrical lead centrally thereof as described in more detail below.

Each of the pins is reinforced by a reinforcing pin 46 depending from and formed integrally with the cover part 31, which pins 46 extend the full length of the pins 33, 34 35.

The plug also comprises a fuse carrier 47 which is removable to enable replacement of a fuse, the fuse holders 38, 40 extending through apertures 37 in the base part 32.

On the underside of the base part 32 are arranged three raised parts or knuckles 48 bearing chamfers 53, the knuckles being adapted to cooperate with the piercing means 36 and the electrical conductors as described in more detail below. Four apertures 49 are also provided in the base part 32, the apertures being adapted to receive pegs 50 on the cover part 31 when the plug is assembled.

The plug is further provided with a cable grip comprising a series of teeth 51 formed integrally with the cover part 31 and a flexible sprag 52 which sits in a slot moulded into the cover part.

The interior face of cover part 31 is also provided with four pegs 54 adapted to be received in holes 55 in the conductive strip 42 connecting the line terminal 36 with the fuse holder 40.

In the assembly of the plug, the three pins 33, 34, 35 are moulded on their respective reinforcing pins 46. As shown particularly in FIGS. 7 and 8 the pins 33, 34, 35 each have a substantially rectangular outline in cross-section and comprise two channel sections 69 each having a web of substantially the same width as that of the other and two flanges 70, disposed one on each side of the web, said channel sections 69 being arranged in opposed relationship with said webs parallel and spaced apart and with each of said flanges 70 extending towards and abutting a corresponding flange of the other channel section, the webs being joined at the tip of the pin. Such pins form the subject of British Pat. No. 1,592,848. The flanges are additionally folded adjacent their free edges so that the free edges 71 face inwardly towards the centre of the pin. The reinforcing pin 46 is provided with longitudinally extending grooves 72 to receive the inturned edges of the abutting flanges to hold the adjacent flanges 70 in contact.

Each of the piercing means 36 of the pins 33, 35 is a press fit in a slot 45 formed in the base of a groove or channel 60 formed in a boss 61 forming an integral part of the cover part 31. The points of the longer teeth 43 terminate below the top of the groove 60 by an amount which is slightly less than the diameter of the conductor 62 with which electrical connection is to be made as shown in FIGS. 10, 11 and 12. In addition, the piercing means 36 of the line terminal is likewise received in a slot 45 of a similar boss 61 and the strip 42 is secured to the cover part 31 by hot staking i.e. welding over, the pegs 54. The fuse holders 38, 40 are also secured to the cover part 31 by hot staking. The cable 63 supported by a cable support 64 is then placed in position, with each conductor 62 overlying a respective piercing means (FIG. 10), and the base part 32 is placed over the conductors, each conductor having first been pressed into its respective groove 60, the sides of which are provided with trapping ribs 65. The chamfered surfaces of the knuckles 48 pick up the conductors 62 as shown in FIG. 10*b*.

At this stage the teeth 43 just engage the insulating sheath of the conductors to locate them against axial displacement. Then, as the cover and base parts are pressed together, the piercing means progressively enter the electrical conductors. Firstly, the outer teeth 43 enter the conducting strand bundle, tightening the strand bundle between them due to the spreading action of the teeth, and then the centre tooth 44 enters the bundle, further tightening the bundle. As this happens, the knuckles 48 are each received in the grooves 60 of the corresponding bosses 61 of the cover part 31. Finally, the position shown in FIG. 12 *a* and *b* is achieved, in which the base part 32 is arranged below a rim 66 on the cover part 31, and the cover and base are secured together either by hot staking of pegs 50 in apertures 49, or as alternatively shown in FIG. 12*b* by means of screws 67. If screws 67 are to be used, of course, the pegs 50 shown in FIG. 1 are replaced by threaded bores.

It will be noted that this method of assembly results in the conductive strip 42 being secured in intimate contact with the cover part 31. This enhances dissipation of heat generated by the fuse into the cover part 31, to ensure that the line terminal 36 is not excessively heated. A similar role is played by holes 67 in the fuse holder and cooperating pegs 68 on the cover part which enhance the conduction of heat from the fuse holders 38, 40 to cover part 31 and hence reduce the flow of heat to the line terminal 36 and line pin 34.

FIGS. 13 to 18 show an electrical interconnector according to the invention in the form of a female socket 100 having three sockets 101, the connector being adapted for electrical connection with a three core power supply cable. The connector comprises an electrically insulating body including a base part 102 and a cover part 103. In each individual socket 101 in the body there is disposed a connector element 104 in the form of a member produced by folding a flat blank (FIG. 18) of sheet metal, the fold lines being shown dotted in FIG. 18.

Each connector element 104 comprises an electrical connector in the form of a socket member 105 adapted to receive a pin 106 of a male pin plug 107, the socket member comprising a web 108 and two flanges 109 connected over part of their length to the web 108. The free portions 110 of the flanges 109 are curved inwardly to constitute spring connectors for frictionally engaging the pins 106 of the male pin plug 107. Formed integrally with each socket member 105 as part of each connector element 104 is an electrical terminal in the form of piercing means 136 identical to the piercing means 36 of the male plus described with reference to FIGS. 1 to 12. As with the male plug the piercing means 136 is mounted in a slot 145 formed in the base of a cable conductor trapping groove 160, the grooves being formed in the base part 102. Likewise knuckles 148 identical to the knuckles 48 of the plug of FIGS. 1 to 12 are provided on the cover part 103 so that electrical connection with a three core cable can be made exactly as with the male plug first described as the parts 102, 103 are brought together.

Base part 102 includes a cable grip comprising teeth 152 and a sprag 151 similar to those of the male plug of FIGS. 1 to 12. Means not shown are provided for securing parts 102, 103 together.

In an alternative form of socket (not illustrated) the middle of the three connector elements and its associated socket may be provided on the cover part 103, the cooperating knuckle 148 being provided on the base part 102.

In both embodiments of the invention described the connector elements are conveniently formed from sheet brass or phosphor bronze.

FIGS. 19 and 20 show respectively to an enlarged scale a plan and elevational view of a modified form of piercing means 36, 136 usable in either of the embodiments described herein wherein each tooth is formed into a W-shape in cross-section, a first fold being provided along the central axis of the tooth and a further fold at each side thereof. An extremely rigid piercing means can be formed in this way from thin sheet material.

The piercing means may also be modified by providing a leading edge on each tooth which is not folded and thus lies in a single plane. This facilitates the piercing of the conductor, and in particular the strand bundle thereof. The portion of the piercing means which enters the slot in the base of the cable conductor trapping groove may similarly be provided with a leading edge which is not folded. This facilitates the entry of the piercing means into the slot.

FIGS. 21 to 28 show an electrical interconnector in the form of a non-rewireable male pin plug suited to meet New Zealand standards comprising three electrical connectors in the form of solid folded male pins 201, 202 and 203. As shown in FIGS. 21 and 22, the plug comprises a moulded plastics cover part 204 and a moulded plastics base part 205.

The pins 201, 202 and 203 constitute an earth pin 201, a line pin 202 and a neutral pin 203, each pin being part of a connector element formed from a sheet metal blank as shown in FIGS. 25 and 27, the fold lines being shown dotted. The pins 201, 202 and 203 are held in position between the cover part 204 and the base part 205 and extend through holes in the base part 205. The pins 201, 202 and 203 are formed integrally with respective conductive strips 206.

Each of the conductive strips 206 has in turn formed integrally therewith as part of the same blank a terminal in the form of means 207 for piercing the insulation of a multi-strand conductor so as to be in electrical contact therewith. Each piercing means 207 comprises three teeth, two outer teeth 208 and a centre tooth 209 shorter than the outer teeth.

Each tooth is bevelled to a pyramidically-shaped sharp point for piercing the insulation of a multi-strand insulated electrical conductor. Each connection element also comprises a pair of ears 210 which are sandwiched between the cover and the base in the assembled plug. The ears 210 of the connector element forming the earth pin are folded perpendicularly to the pin and lie flat on a shelf portion 111 of the base and are pressed against the shelf portion 211 by the piers 212 of an arch portion of the cover. The ears 210 of the connector elements forming the line and neutral pins are bent through an angle of approximately 60° relative to the piercing means 207 and are sandwiched between the base and rectangular columns 213 formed integrally with the cover.

The cover 204 is also provided with three raised parts or knuckles 214 each bearing chamfers 214 to define a grooved upper surface to cooperate with an electrical conductor. The interior face of the cover part is further provided with four pege 216 which enter corresponding apertures 217in the base part in the assembled plug.

The interior face of the base part is provided with three grooves 218 formed in a boss forming an integral part of the base part. Each groove 218 has a slot 219 in the base thereof to mount as a press fit the piercing means of one of the pins. Each groove 218 has trapping ribs 228 on the inside surfaces thereof which serve to trap an electrical conductor pressed into the groove and is shaped to receive a respective one of the knuckles 214.

The base part is further provided with two pillars 220 of circular cross-section and two pillars 221 of semicircular cross-section.

A cable grip is also provided, comprising a series of teeth 222 formed integrally with the base part 205 and a flexible sprag 223 which sits in a slot also formed in the base part. The plug is assembled and wired as follows: Firstly, the connector element blanks for the pins and piercing means are folded, the sides 224 of the pins being folded flat against the central portion 225 as described and shown, the folds taking place along the dotted lines shown in FIGS. 25 and 27. The three pins are then inserted through their respective holes in the base part 205. Each of the piercing means 207 is of a thickness such as to be a press fit in its respective slot 219, the teeth 208 and 209 extending upwardly within their respective grooves 218, as shown for the line terminal in FIG. 23. The points of the longer teeth 208 terminate below the top of the grooves 218 by an amount which is slightly lower than the diameter of the conductor with which electrical connection is to be made. The sprag 223 is then also inserted in the base part.

A cable 226, supported by a cable support 227 is then placed in position, as shown in FIG. 26, with each of the three conductors overlying a respective piercing means. The line and neutral conductors are each passed around respective pillars 220, 221 to prevent kinking and to increase frictional forces resisting pulling of the conductors out of the plug. Each conductor is pressed in place in its respective groove 218, the trapping ribs 228 holding the conductors in place. At this stage the teeth 208 just engage the sheath of the conductors to locate them against axial displacement.

The cover part 204 is then placed over the base part, the knuckles 214 entering the grooves 218, the chamfers 215 picking up the electrical conductors.

As the cover part 104 and base part 205 are pressed together, the piercing teeth progressively enter the electrical conductors. Firstly, the outer teeth 208 enter the conductive strand bundle, tightening the strand bundle between them due to the spreading action of the teeth, whereafter the central tooth 209 enters the tightened bundle, causing further tightening to take place. Finally, the position shown in FIG. 24 is attained, in which the teeth 208, 209 have entered apertures 229 in knuckles 214, having passed diametrically through the insulated conductors. In addition, the pegs 216 of the cover part enter aperture 217 in the base part and are hot staked or welded over permanently to connect the base and cover parts. In the completed plug, the ears 210 associated with the earth pin 201 are clamped between the pins 212 and the shelf 211, and the ears 210 associated with the line and neutral pins 202, 203 are clamped between the columns 213 and the inside surface of the base part 204. Further stability of the pins is assured by the mounting of the piercing means in the slots 219 and the location of the teeth in the appertures 229.

Electrical interconnectors according to the invention have been described having connector members in the form of male pin plugs and female sockets. The invention may as previously stated be applied to other forms of connector members. Thus, for example, an electrical interconnector may be provided for a bayonet-type light fitting which conventionally includes two connector members in the form of rods slidably mounted in an insulating housing and spring biased outwardly for engagement with the terminals provided on the end of an electric light bulb. Conventional terminals of the light fitting take the form of nuts engaging in threaded bores in terminal pillars cross bored to receive the bared ends of electrical conductors. According to the invention this arrangement of conventional terminals and rod connectors would be replaced by interconnectors according to the invention wherein the connectors would be constituted by conductive strips integral with terminal piercing means, said strips being formed and disposed for engagement by the terminals of an electric light bulb. These strips could if desired be spring biased and provided with contact members soldered or rivetted thereto.

The advantages of the construction according to the invention will be readily apparent including:

1. The electrical interconnector is formed from one piece from the electrical connector to the electrical terminal, thus reducing the number of components and hence the cost.

2. The electrical terminal is connected to the wire multistrand conductor with no special preparation, thus again reducing the cost and increasing the reliability of the connection.

3. Since the insulation is not removed from the multistrand conductor no special care is necessary to hold the strands together, and one or more strands cannot escape to present an an electrical hazard.

4. As the piercing means pierces the strand bundle a good electrical connection is made enabling heavy currents to be carried without difficulty.

5. The one physical configuration of piercing means has been found suitable for widely rated conductors e.g. from 3 amps to 13 amps having overall diameters from 2.0 to 3.0 mm.

An interconnector according to the invention may be made in the form of a plug widely used in Europe, having hollow live and neutral pins of circular crosssection and an earth in the form of a conductive strip extending along the surface of the body of the plug. In such a plug, the hollow pins and the earth strip are each formed from sheet metal together with an associated terminal and the hollow pins are reinforced by reinforcing pins extending from the cover part of the plug, as described herein in the embodiment of FIGS. 1 to 12.

I claim:

1. In apparatus for selectively establishing an electrical circuit, the apparatus including at lesat one electrical connector member for engagement with and disengagement from a complementary electrical connector member, the circuit establishing apparatus having a nonconductive housing, a terminal disposed in the housing and being associated with and electrically connected to each electrical connector member whereby each connector member of the circuit establishing apparatus may be electrically connected to an insulated multi-strand conductor by means of said terminal, the improvement comprising said terminal being formed from sheet material and including at least one tooth having a sharp leading end adapted to enter the insulation of an insulated multi-strand conductor from one side, pass through the strand bundle of the electrical conductor and then pass through the insulation at the opposite side to that at which the tooth entered the insulation to make electrical connection with the conductor, said at least one tooth being located in a groove, said groove having at least a first irregularly shaped side wall and a minimum width which is less than the diameter of the insulated electrical conductor whereby said groove defines a trap to receive as a press-fit the insulated electrical conductor, the sharp leading end of the tooth of said terminal being located below the top of said groove whereby the insulated conductor is guided by the groove as it is forced onto said at least one tooth.

2. The apparatus of claim 1 wherein the connector member associated with said terminal is in the form of a socket.

3. The electrical interconnector of claim 1 wherein said groove is defined by a pair of side walls which at all oppositely disposed points are substantially parallel.

4. The apparatus of claim 1 wherein said housing is comprised of two parts and said groove is located in a first part of the housing and a second mating part of the housing is provided with a projection adapted to enter said groove and engage the conductor so as to force the conductor into the groove and onto said at least one tooth.

5. The apparatus of claim 4 wherein a recess is provided in said projection to receive the end of said at least one tooth which extends through the conductor.

6. The apparatus of claim 1 wherein the terminal has three teeth and the intermediately disposed of said teeth is shorter than the two outer teeth.

7. The apparatus of claim 6 wherein each of said teeth is folded along at least on line extending in the direction in which the tooth enters the electrical connector.

8. The apparatus of claim 7 further comprising a slot in the base of said groove, said fold forming an interference fit in said slot.

9. The apparatus of claim 7 wherein said folds extends axially along each of said teeth and wherein at least one further fold is provided on each side of each of said teeth.

10. The apparatus of claim 9 wherein each of said teeth is W-shaped in cross-section.

11. The apparatus of claim 1 wherein the connector member associated with said terminal is in the form of a male pin plug.

12. The apparatus of claim 11 wherein said terminal has an integral fuse holder and said male pin plug connector member has an integral fuse holder, said male pin plug being positioned so that said terminal and pin plug may be interconnected by a fuse received in said holder.

13. The apparatus of claim 11 wherein said male pin plug connector member has a substantially rectangular outline in cross-section and comprises two channel sections, each of said channel sections having a web of substantially the same width and two flanges disposed one on each side of the web, said channel sections being arranged in opposed relation with said webs parallel and spaced apart and with each of said flanges extending towards and abutting a corresponding flange of the other channel section, the webs being joined at the tip of the pin plug.

14. An electrical connector for engagement with and disengagement from a cooperating electrical connector to establish electrical connection therewith, said connector comprising:

a first housing member, said first housing member defining at least a first interior groove, said groove being formed as a trap to receive as a press fit an electrical connector, a slot being located in the base of said groove;

a second housing member, said second housing member cooperating with said first housing member to define the housing of said connector, said second housing member being provided with an interior projection which is positioned so as to enter said first housing member groove and engage a conductor positioned therein;

an electrical connector member supported by said housing defined by said first and second housing members, said connector member being adapted to engage a complementary shaped electrical connector member to make electrical connection therewith; and a terminal electrically connected to said electrical connector member, said terminal comprising a plurality of teeth, each of said teeth having a sharp leading end adapted to enter the insulation of an insulated conductor and to pass through the conductive core of the electrical conductor, each of said teeth being folded along at least one line extending in the direction in which the tooth enters the electrical conductor, said terminal being received as an interference fit in said slot in the base of said first housing member groove.

15. The electrical connector of claim 14 wherein said first housing member first interior groove has at least a first irregularly shaped side wall.

16. The electrical connector of claim 15 wherein said first housing member first interior groove is defined by a pair of side walls, said side walls at their points of closest separation defining a pair of substantially parallel planes.

* * * * *